US007357701B2

(12) United States Patent
Gautier et al.

(10) Patent No.: US 7,357,701 B2
(45) **Date of Patent: *Apr. 15, 2008**

(54) WATER DRIVEN ROTARY TOOL

(76) Inventors: Dan Gautier, 5960 SW. 78th St., Miami, FL (US) 33143; Jose Gentilcore, 12551 NW. 78th Manor, Parkland, FL (US) 33076; Marcelo Dario Didone, 3721 W. Hillsboro Blvd., Coconut Creek, FL (US) 33073; Jorge Alfredo Coyetano Didone, 2041 NE. 56th St., Apt. #A, Ft. Lauderdale, FL (US) 33308

( * ) Notice: Subject to any disclaimer, the term of this patent is extended or adjusted under 35 U.S.C. 154(b) by 240 days.

This patent is subject to a terminal disclaimer.

(21) Appl. No.: 11/101,928

(22) Filed: Apr. 8, 2005

(65) Prior Publication Data

US 2006/0229005 A1 Oct. 12, 2006

Related U.S. Application Data

(63) Continuation-in-part of application No. 11/102,110, filed on Apr. 7, 2005.

(51) Int. Cl.
*B24B 23/00* (2006.01)

(52) U.S. Cl. ..... 451/359; 451/353; 451/344

(58) Field of Classification Search ..... 451/359, 451/352–354, 356, 358, 344, 158–160
See application file for complete search history.

(56) References Cited

U.S. PATENT DOCUMENTS

| | | | | |
|---|---|---|---|---|
| 1,905,424 | A | 4/1933 | Schlieper | |
| 4,193,228 | A | 3/1980 | Bowler | |
| 4,229,139 | A | 10/1980 | Marantette et al. | |
| 4,244,524 | A | 1/1981 | Wellings | |
| 4,463,525 | A | 8/1984 | Sheber | |
| 4,775,241 | A | 10/1988 | Stuckey | |
| 5,153,962 | A | 10/1992 | Ritter | |
| 5,620,364 | A | 4/1997 | Torrance et al. | |
| 6,203,415 | B1 | 3/2001 | Torrance-Castanza et al. | |
| 6,205,607 | B1 * | 3/2001 | Tse | 15/29 |
| 6,561,287 | B2 | 5/2003 | DeBlasio | |
| 6,637,679 | B1 | 10/2003 | Duncan et al. | |
| 6,669,876 | B2 | 12/2003 | Torrance | |
| 6,695,573 | B2 | 2/2004 | Snider | |
| 2006/0233639 | A1 * | 10/2006 | Gentilcore et al. | 415/151 |

* cited by examiner

*Primary Examiner*—Dung V Nguyen
(74) *Attorney, Agent, or Firm*—McHale & Slavin, P.A.

(57) ABSTRACT

The present invention provides an assembly of machined or precision cast components which combine to form a high pressure water powered rotary tool. The rotary tool includes a rigid metal housing, a high pressure water inlet, an impeller rotatably mounted within the housing, an output drive shaft, a backing disk and at least one handgrip or alternatively an extendable handle capable of articulation throughout an extended range. The rotary tool is attachable to a pump driven by an electric motor or internal combustion engine.

14 Claims, 9 Drawing Sheets

WATER DRIVEN ROTARY TOOL

CROSS REFERENCE TO RELATED APPLICATIONS

This application is a continuation-in-part of applicant's co-pending U.S. application Ser. No. 11/102,110 entitled Water Driven Motor filed Apr. 7, 2005 the contents of which are hereby incorporated by reference in their entirety.

FIELD OF THE INVENTION

This invention relates generally to high pressure water powered tools. More specifically, the present invention relates to a high pressure water powered rotary tool used for grinding, polishing, or sanding of many surfaces, including stone, cement, fiberglass, wood and metal surfaces, wherein the tool is generally used in a water containing or wet environment.

BACKGROUND INFORMATION

Throughout industry and within the home, a need exists for tools that can be safely used within wet environments. This is particularly true of areas in and around swimming pools where a high risk of electrical shock exists with the utilization of conventional power tools.

Water driven rotational tools are known in the prior art. U.S. Pat. No. 1,905,424 issued to R. Schlieper, dated Apr. 25, 1933, shows a water driven washing apparatus which is a cleaning apparatus for cars that uses pressurized water supplied via a garden hose to provide rotary motion to a sponge. The exhausting water is deflected downwardly through a disc having a plurality of apertures into a sponge that is used to wash a vehicle.

U.S. Pat. No. 4,193,228 issued to Bowler, dated Mar. 18, 1980, provides a water-driven tool that can be used for polishing tile around a swimming pool or shower in a wet environment.

U.S. Pat. No. 4,463,525 issued to Sheber, dated Aug. 7, 1984, shows a hand-held cleaning tool with a remote water turbine power source contained in a floating housing. The outlet of the water turbine is connected to one end of a suction hose. A flexible drive cable assembly has one end connected to the cleaning tool and the other end connected to the water turbine.

U.S. Pat. No. 5,620,364 issued to Torrance et al., dated Apr. 15, 1997, shows a hand-held water-driven rotary tool. The tool uses water pressure to drive an internal impeller and reducer gear to create the torque required for use. A major drawback of this device is the requirement of an internal gear-train. The impeller must rotate at about 20,000 RPM to create the torque necessary to spin the cutting disc at 3,000 to 4,000 RPM, which is the required speed necessary to complete an ordinary job. The heat generated at 20,000 RPM tends to wear down the internal bearings which can ultimately lead to the bearing spinning faster than the shaft. This decreases the torque, creating cavitation, internal damage and insufficient performance.

U.S. Pat. No. 6,203,415 issued to Torrance-Castanza et al., dated Mar. 20, 2001, shows a direct-drive, water-driven rotary tool. The device includes a housing having a central cavity, an impeller with angled, beveled blades around its periphery, a drive shaft connected to a rotatable mounting pad or backing pad that contains a disc with a grinding or sanding surface that is removably attached thereto. The device also includes a high pressure water inlet conduit having a changeable nozzle to allow using the tool with different water sources to maintain a constant RPM. The water exiting the nozzle strikes the blades of the impeller, rotating the impeller, which rotates the backing pad and sanding disc. Exhausting water is diverted downwardly through a bearing mounting plate having holes that allows the expended water from the impeller to be expelled peripherally around the outside of the main cavity of the housing. The device also includes a manually-actuated trigger for the inlet water valve which can be held at the same time as a D-shaped handle affixed directly on the housing.

While the prior art devices are suitable for use in wet environments, they include numerous drawbacks. One such drawback has prevented the prior art devices from use in heavy duty applications. The drawback relates to the torque the prior art devices are capable of developing. Grinding soft surfaces or washing the paint on a vehicle only requires a small amount of torque to complete the task. However, heavy duty applications, such as grinding hard materials, e.g. granite or structural concrete, requires significantly more torque. The impeller constructions of the prior art typically utilize an impeller which has a single side plate. The single side plate includes a plurality of upwardly projecting curved blades which the water is impacted against. This construction does not adequately control the flow path of high pressure water. The single side plate allows the water to flow over the top of the blades to impact opposing blades causing drag on the impeller. The result is reduced efficiency and reduced torque.

Another problem with the devices shown in the prior art is that they do not sufficiently control the exhausting water. The failure to control the exhausting water prevents their use in environments that must be kept substantially dry. For example, it is becoming common to cast counter tops from structural concrete. The counter tops are cast in place within the home. After casting, the concrete requires grinding and polishing to create a suitable surface finish for home interiors. The devices shown by Torrance-Castanza exhaust water in a generally uncontrolled manner through a plurality of apertures in the lower portion of the device. The water is directed downwardly around the entire periphery of the device onto the backing pad. The backing pad spins at a high rate of speed causing the exhausted water to spray outwardly throughout a large circumference, making this construction unsuitable for working in environments which must be kept substantially dry.

The present invention overcomes these problems by providing a high torque water-driven tool which provides a controlled exhaust. The device includes a hydrodynamically designed impeller within a hydrodynamically designed housing to provide substantially increased control of water flow when compared to the prior art. The controlled flow of high pressure water through the motor provides increased efficiency and directed exhaust. The device can be specially adapted for a plurality of uses within a wet environment such as a pool where it would not be practical to provide electrical power directly to the tool due to the dangers of electrocution. The device can also be utilized within closed generally dry environments without the destructive over-spray of the prior art. The grinding device may be utilized for grinding or polishing stones, cement, fiberglass, and even wood and metal surfaces.

Also, from a versatility standpoint, the assembled device is lightweight and easily manipulated. The device includes at least one fixed handgrip for tasks in close proximity to the operator. The device accommodates an extendable handle which permits a complete range of articulation for tasks which require extended operator reach.

There are also commercial considerations that are satisfied by the viable water driven rotary tool device; considerations which are not entirely satisfied by state of the art products. The water driven rotary tool is formed of relatively few component parts that are inexpensive to manufacture by conventional techniques. In addition, the device components are formed of corrosion resistant materials for long useful life.

BRIEF DESCRIPTION OF THE INVENTION

The present invention provides an assembly of machined or precision cast components which combine to form a high pressure water powered rotary tool. The rotary tool includes a rigid metal housing, a high pressure water inlet, an impeller rotatably mounted within the housing, an output drive shaft, a backing disc and at least one handgrip, or alternatively an extendable handle for an extended reach. The rotary tool is attachable to a water pump driven by an electric motor or internal combustion engine.

The housing is generally constructed from a material such as anodized aluminum. The housing includes a centrally located impeller cavity for containing the rotatably mounted impeller. The housing preferably includes an upper portion and a lower portion, the lower portion includes a removable and replaceable bearing suitable to support the drive shaft. The drive shaft extends through the impeller, the bearing, the housing and a backing disk to insure rotation of the backing disk with the impeller.

The impeller cavity includes a unique exhaust channel which diverts the water away from the impeller and through an exhaust aperture in a controlled manner. The exhaust channel is generally oval in shape and extends around a portion of the impeller cavity. The centrifugal force generated by the spinning impeller causes the water to flow away from the impeller and through the exhaust aperture. This method allows the duration that the water contacts the impeller to be accurately controlled, reducing drag and thereby increasing the efficiency of the device. This construction also allows the maximum power to be produced by the high pressure water supplied to the device.

The housing also includes a plurality of integrally formed bosses. One of the bosses is utilized for attaching a rigidly mounted handgrip or an extended handle. The handle may include extensions for long reach applications and/or a universal type coupling pivotal movement throughout an extended range. An integrally machined inlet conduit is utilized to attach the water powered rotary tool to a source of high pressure water. A removable and replaceable water nozzle is positioned within the water inlet to direct a high pressure water jet into the impeller at an angle substantially perpendicular to the impeller's axis of rotation. Directing the water into the impeller perpendicular to the impeller's axis of rotation results in a high impulse-momentum force being imparted to the impeller for a given water pressure or flow. The water nozzle is interchangeable to control the rotational speed and/or torque developed by the tool. The water nozzle includes an inner aperture which may be varied in diameter and/or constructed to direct a narrow or wide angle high pressure spray into the impeller to cause the water to strike one or more of the chevron shaped impeller vanes causing rotation. The various nozzle configurations may be utilized to produce the desired torque and/or revolutions per minute suitable for the working surface.

The impeller is a unique design having a predetermined number of vanes, each vane includes a chevron shape and cusped edges to improve performance and more equally disperse the load across a plurality of vanes. The impeller includes a pair of side discs which control the flow of the water by preventing the water from spilling over either the top or the bottom of the vanes thereby increasing rotational torque developed by the device. The output drive shaft is secured through the center of the impeller extending outwardly from either side. The drive shaft includes sufficient length to engage the impeller and the bearing incorporated into the lower portion of the housing to provide bearing support for the impeller and the backing disc. The drive shaft includes sufficient length to extend through the impeller as well as an aperture in the lower portion of the housing for securement to the backing disc. The backing disc includes a means of attaching polishing, sanding or grinding materials, well known in the art, thereto.

A hand actuated trigger assembly may be attached to the hand grip or extended handle to operate a water inlet valve assembly. The water inlet valve assembly allows the water to be turned on and off to the device. The high pressure water is typically supplied by a gas engine or electric motor turning a pump as is well known in the art. These devices typically supply between 1 and 8 gallons of water per minute at about 1000 pounds per square inch or more.

The water inlet valve includes a valve actuating trigger or lever that can be squeezed with a person's hand. Water received from the high pressure water source comes through an inlet conduit and the nozzle to strike the impeller, causing the drive shaft to rotate as the impeller rotates, which in turn rotates the backing pad. The water that is expended against the impeller blades is centrifugally evacuated through the exhaust channel which directs the water outwardly through the exhaust aperture and away from the backing pad.

It is therefore an objective of this invention to provide a high-pressure water driven rotary tool capable of delivering high torque especially used for sanding, grinding or polishing within a dry or wet environment without danger of electrical shock.

Another objective of the instant invention is to provide a water driven rotary tool which includes a unique impeller construction having a pair of side plates to produce high torque rotary motion.

It is yet another objective of the present invention to provide a water driven rotary tool which includes a unique exhaust channel which utilizes centrifugal force to provide controlled exhaust of water in contact with impeller vanes to reduce parasitic losses caused thereby.

Other objectives and advantages of the present invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENTS

Figure 1:
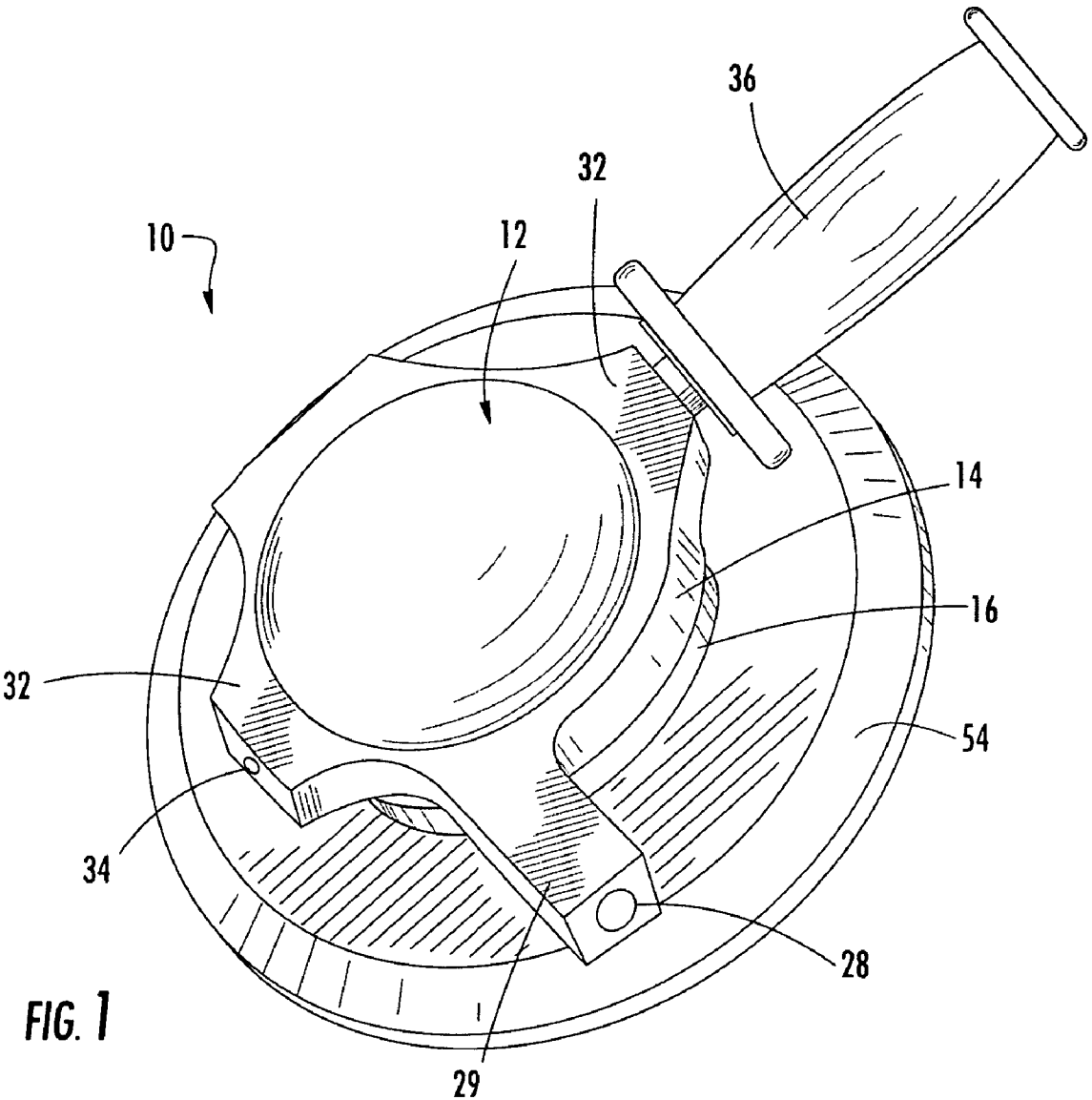
FIG. 1 is a top perspective view of the instant invention.
Figure 2:
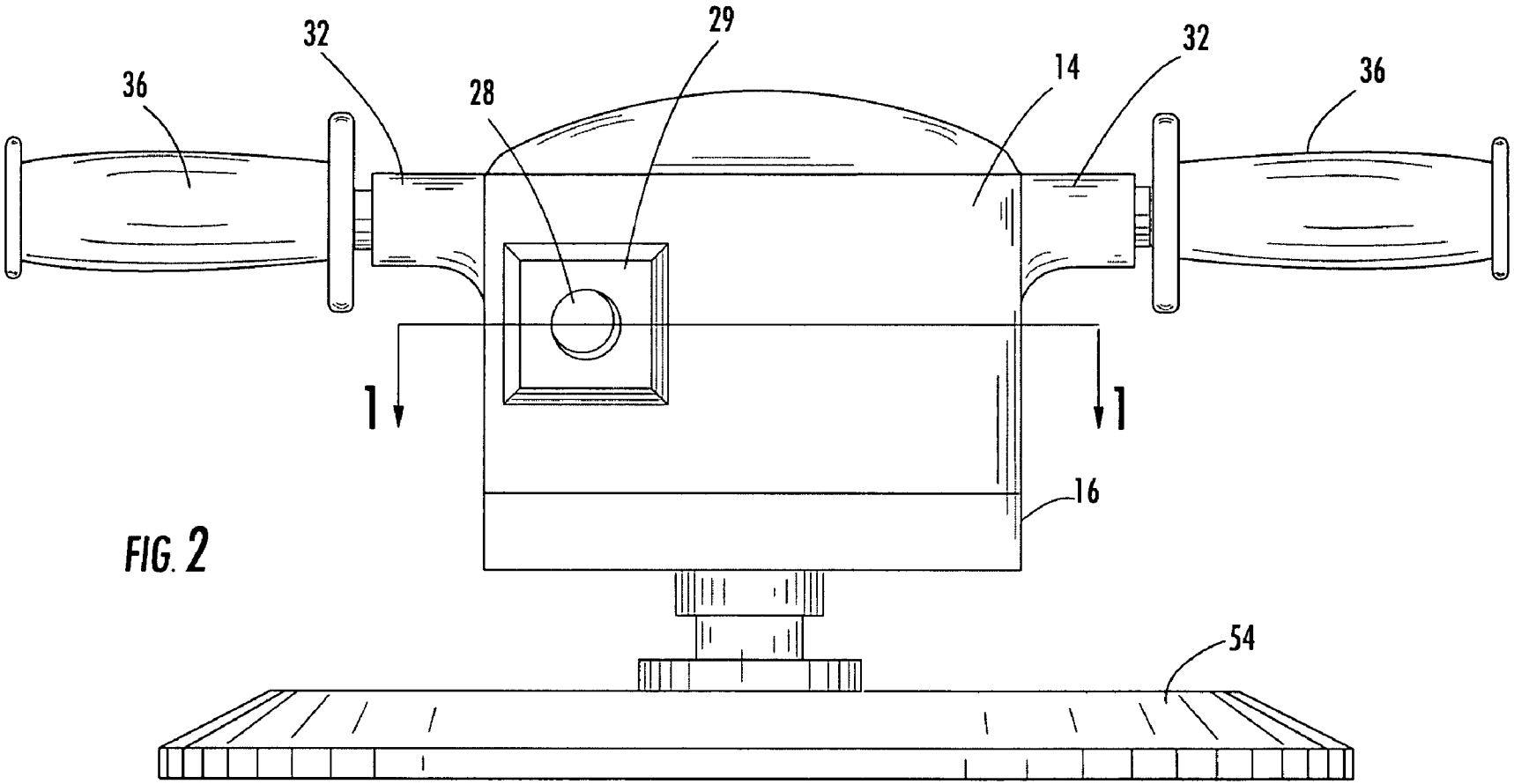
FIG. 2 is a front elevational view of the instant invention.
Figure 3:
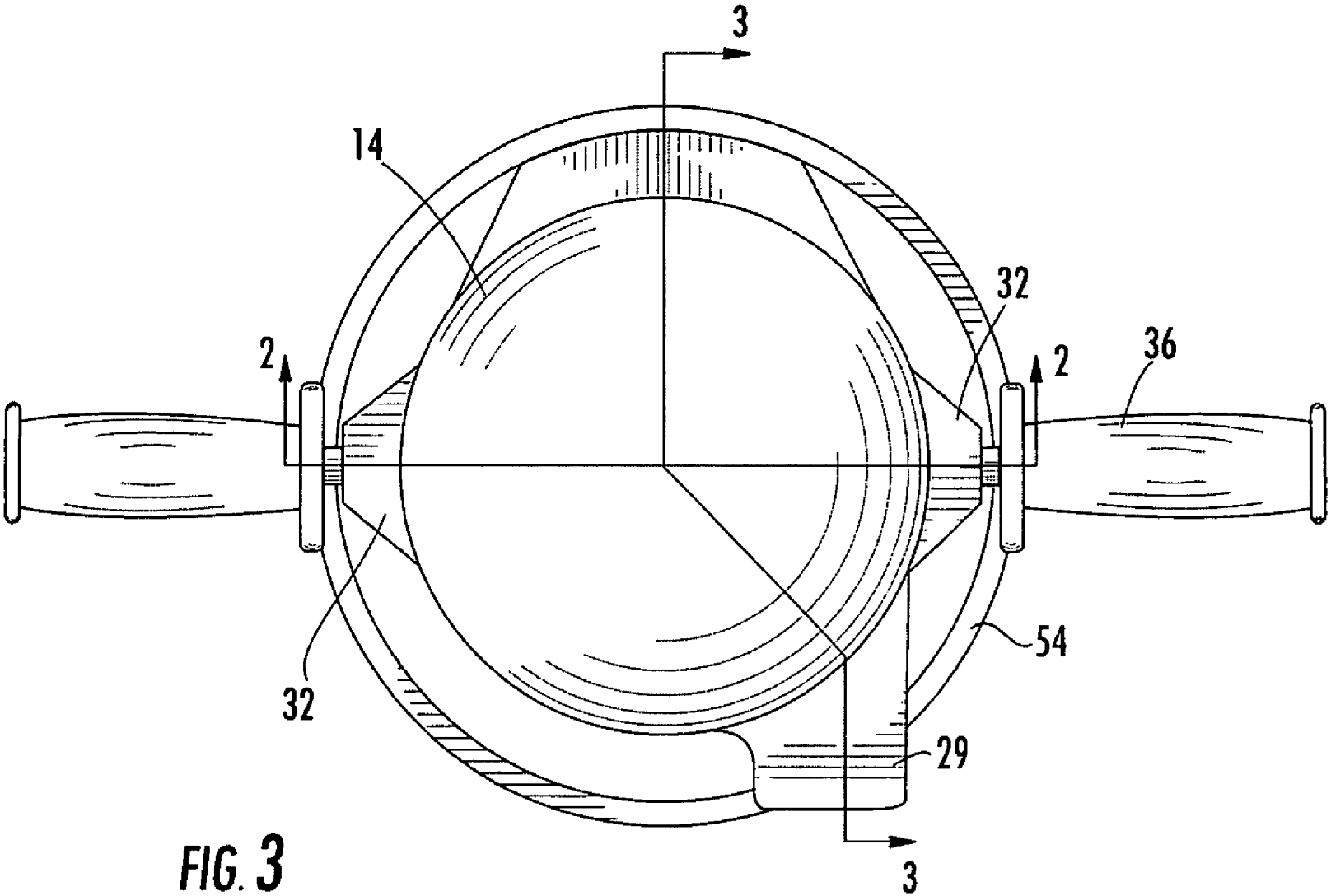
FIG. 3 is a top view of the instant invention.
Figure 4:
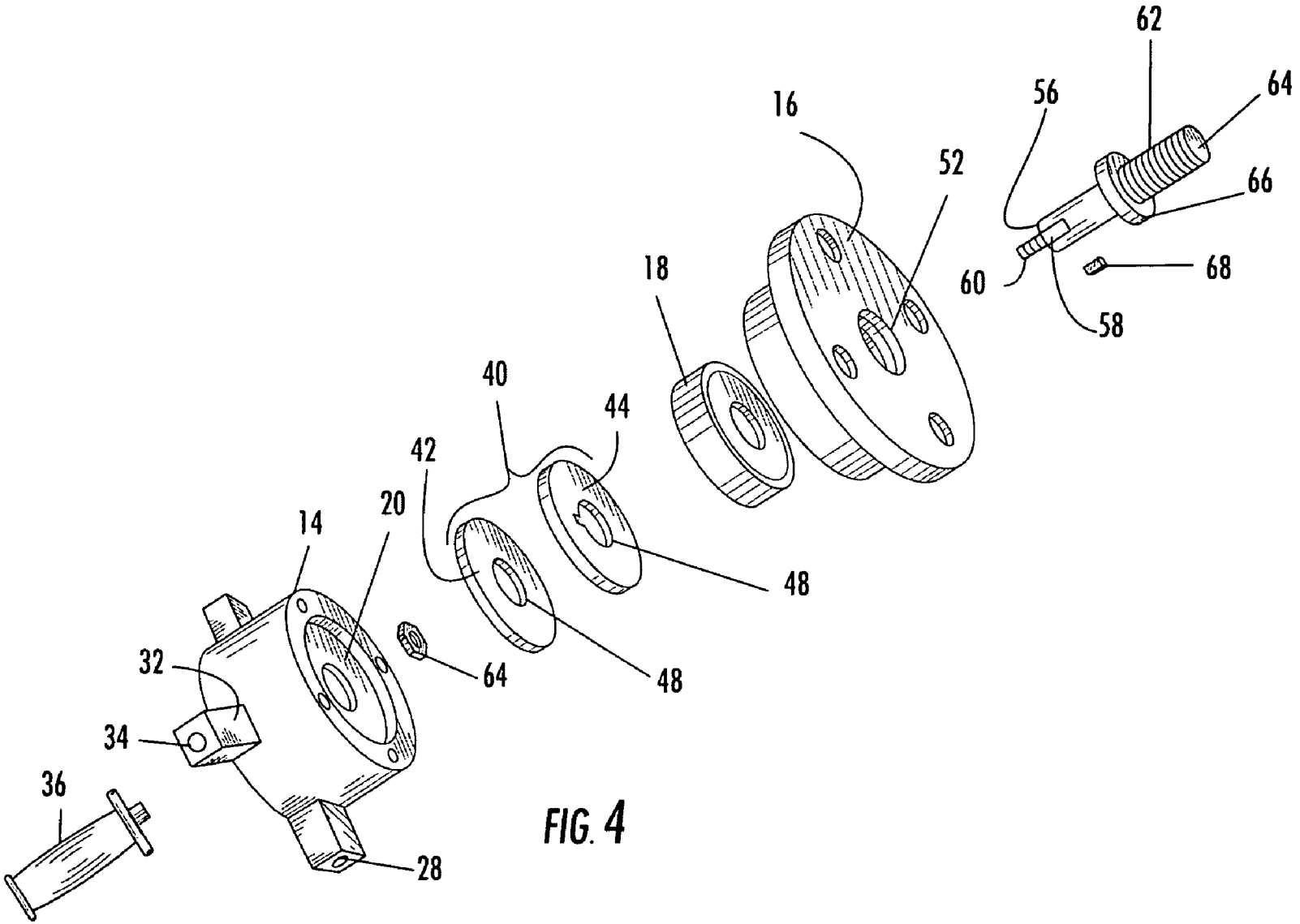
FIG. 4 is a bottom perspective exploded view of the water motor utilized in the instant invention.
Figure 5:
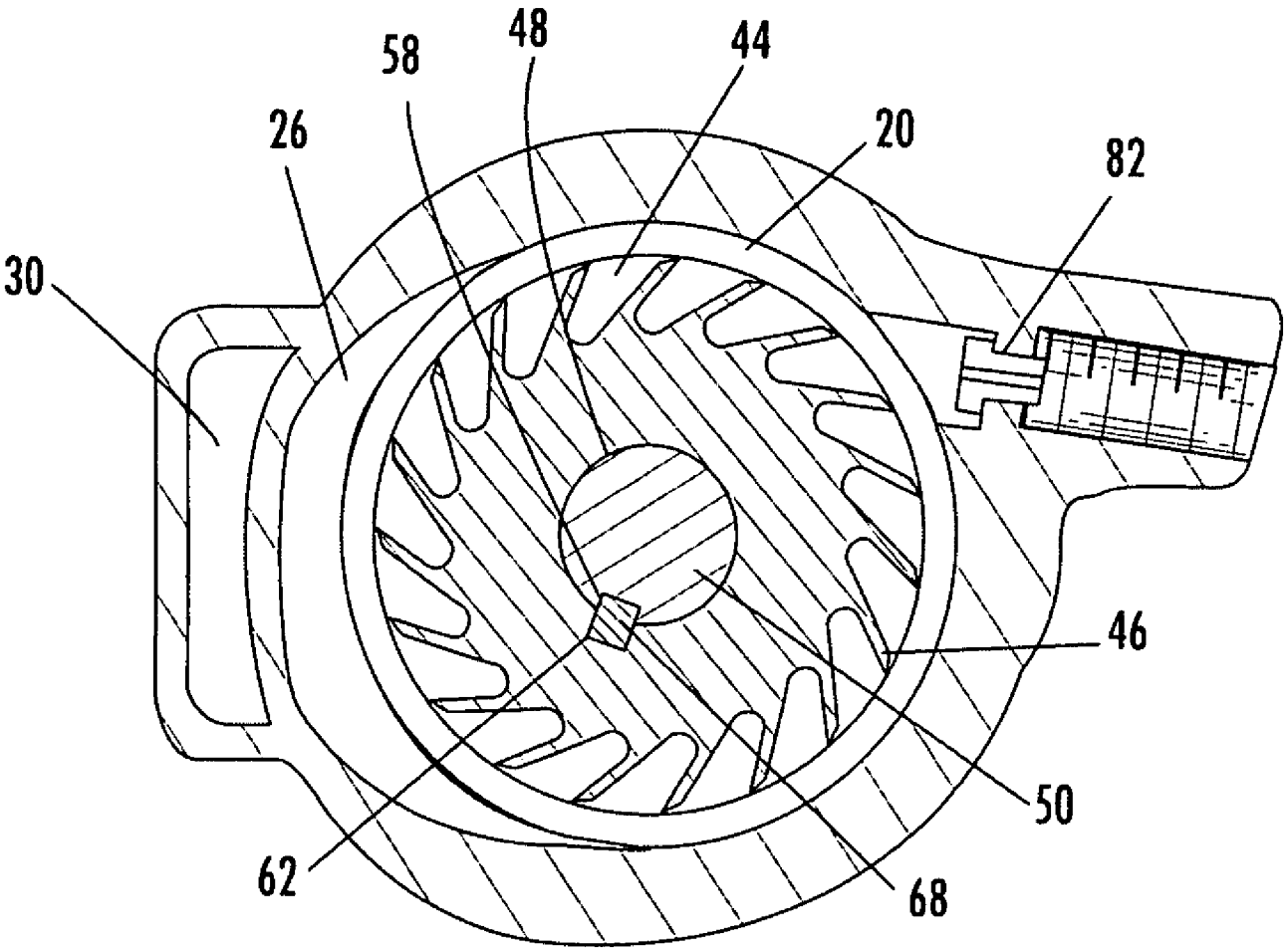
FIG. 5 is a section view of the instant invention taken along line 1-1 of FIG. 2.
Figure 6:
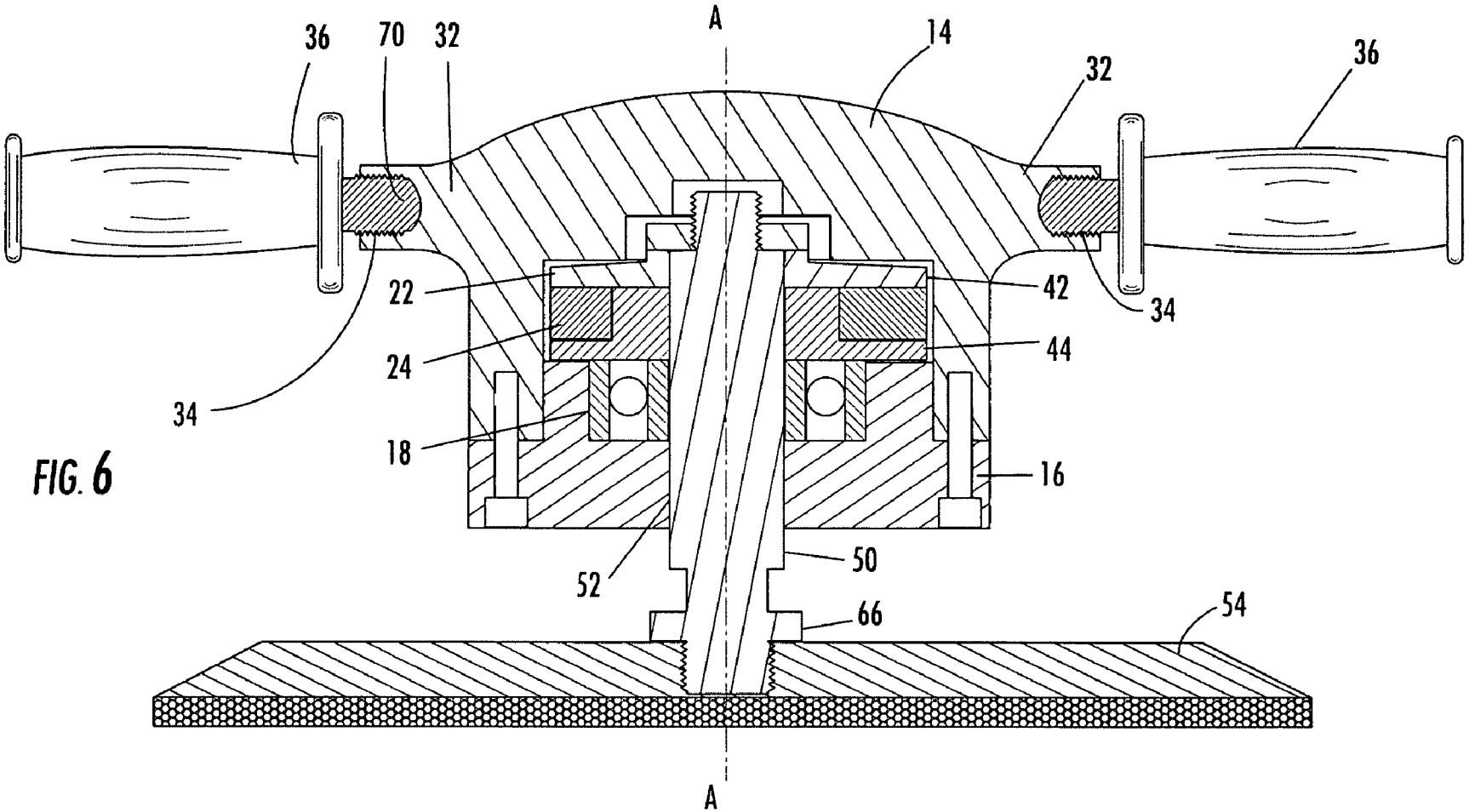
FIG. 6 is a section view of the instant invention taken along line 2-2 of FIG. 3.
Figure 7:
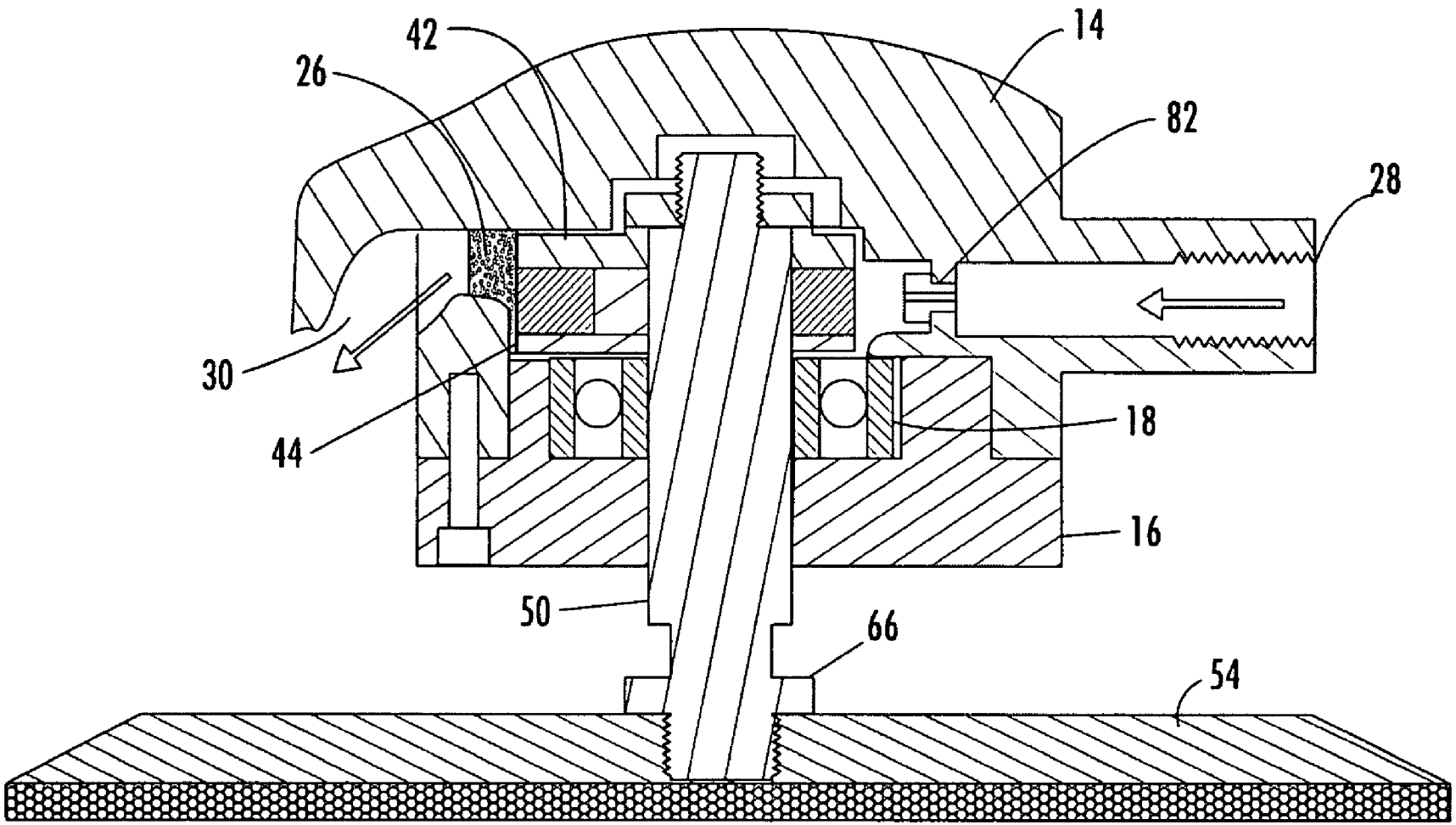
FIG. 7 is a section view of the instant invention taken along line 3-3 of FIG. 3.
Figure 8:
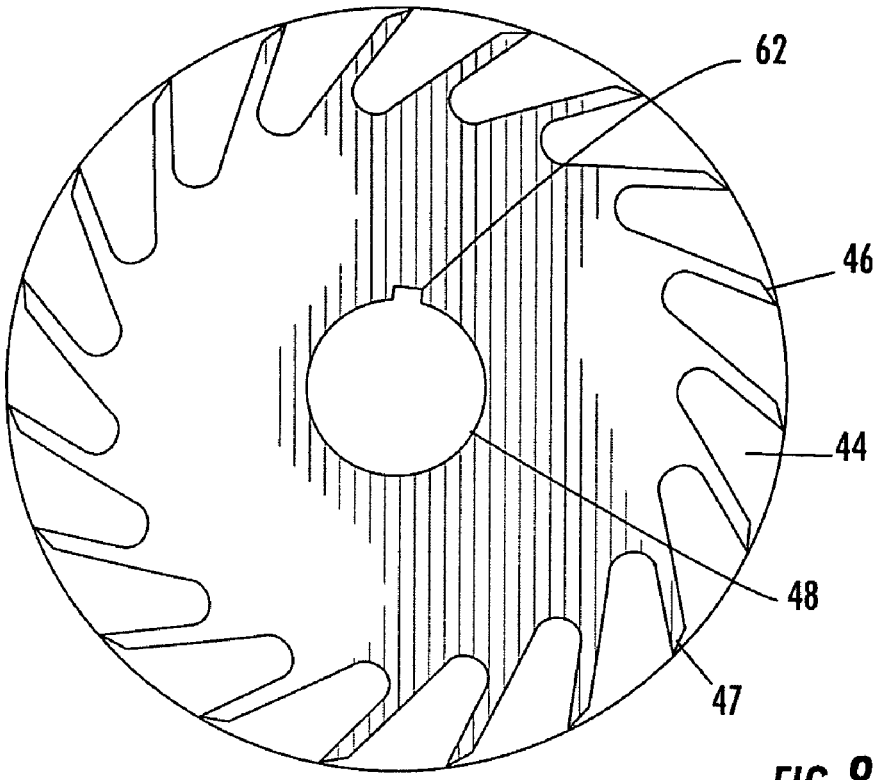
FIG. 8 is a top view of the impeller utilized in the instant invention illustrating the vane construction, the upper side plate having been omitted for clarity.
Figure 9:
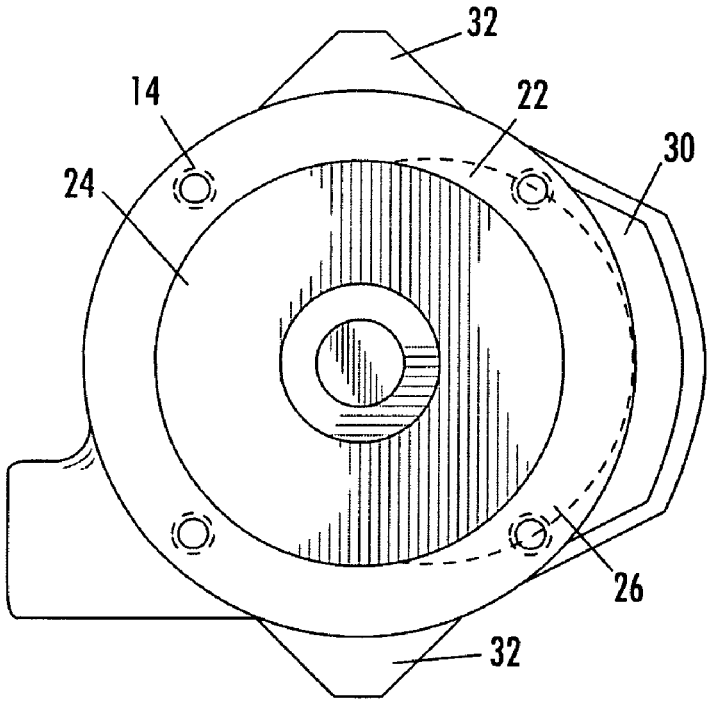
FIG. 9 is a bottom view of the upper portion of the housing, the remaining components having been omitted for clarity.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

Referring to FIGS. 1-9, the preferred embodiment of the water powered rotary tool 10 is illustrated. The water powered rotary tool generally includes a housing 12, the housing including an upper portion 14 and a lower portion 16. The lower portion includes a removable and replaceable first bearing 18. The first bearing is axially aligned within a centrally located impeller cavity 20. A water inlet 28 is centrally located within an integrally formed conduit 29 for allowing high pressure water into the impeller cavity 20. The impeller cavity includes an upper portion 22 and a lower portion 24. The lower portion of the impeller cavity having a substantially cylindrical shape when viewed from the top while the upper portion of the impeller cavity includes an exhaust channel 26 giving the exhaust channel a substantially oval shape. The exhaust channel 26 is constructed and arranged to utilize centrifugal force to direct the high pressure water to a water exhaust 30 for exhausting the high pressure water from the impeller cavity. A water inlet nozzle 82 and the exhaust channel 26 are positioned to control the duration in which the high pressure water is in contact with the impeller 40. In a most preferred, but non-limiting embodiment, the water remains in contact with the impeller between 90 and 180 degrees. In this manner the instant invention eliminates a substantial portion of the parasitic losses found within the prior art.

Figure 11:
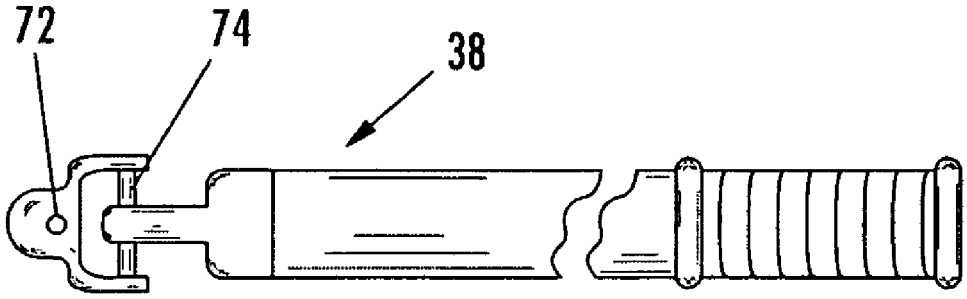
FIG. 11 is a side view of an extended handle for use with the instant invention.

Still referring to FIGS. 1-9, the housing includes a plurality of integrally formed bosses 32 on an external surface thereof. Each boss includes a threaded aperture 34 for removable attachment of a handgrip 36 or extendable handle 38 (FIG. 11).

Referring to FIGS. 4-8 the preferred embodiment of the impeller 40 is illustrated. The impeller includes an upper side plate 42 and a lower side plate 44. Extending between said side plates are a plurality of chevron shaped vanes 46 having cusped edges 47 for increased performance. In a most preferred embodiment the impeller includes about nineteen vanes arranged around the perimeter of the impeller. The impeller also includes a centrally located aperture 48 for a drive shaft 50. The drive shaft 50 defines an axis of rotation A for the impeller. The drive shaft 50 extends through the impeller aperture 48 and engage the impeller as well as the first bearing 18. The drive shaft includes sufficient length to extend through aperture 52 centrally located in said lower portion of the housing 16 for attachment to a backing disc 54. The upper portion of the drive shaft 56 includes an inner key-way 58 and a threaded stem 60. The key-way aligns with outer key-way 62 in the impeller aperture 48 and lock-nut 64 engages the threaded stem 60 to secure the impeller and the drive shaft securely together. In this manner the impeller and the drive shaft rotate together, and the upper and lower impeller side plates are prevented from separation. The lower portion of the drive shaft 62 includes a threaded portion 64 and a flange 66 for attachment to the backing disk 54. The backing disk 54 is constructed and arranged for attachment of an abrasive medium (not shown) to the drive shaft, wherein rotation of the impeller causes rotation of the backing disk for grinding, polishing etc. The backing disk may include hook and loop, adhesive, snaps or other means of securing the abrasive medium to the backing disk which are well known in the art.

Referring to FIGS. 1-6 and 11, a handgrip 36 for operator manipulation of the water powered rotary tool is illustrated. The handgrip 36 includes a threaded stem 70 for removable attachment to one of the integrally formed bosses 32. The handgrip may be removed and the extendable handle 38 may be secured in its place via a standard fastener placed through aperture 72. The extendable handle includes a universal joint 74 which allows the handle to be articulated through a large range. The extendable handle may include a telescoping section (not shown), well known in the art for varying the length of the extendable handle.

Figure 10:
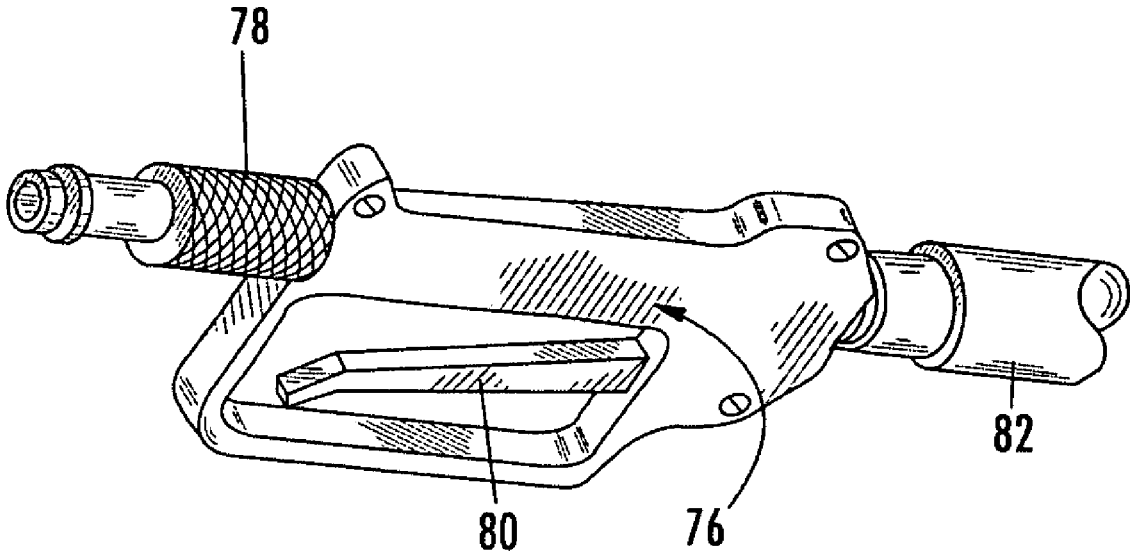
FIG. 10 is a perspective view illustrating a valve assembly suitable for use with the instant invention.

Referring to FIG. 10, a water inlet valve 76 is illustrated. The water inlet valve is generally constructed and arranged for connecting the water powered rotary tool 10 to a source of high pressure water. Sources of high pressure water are well known in the art and may include an internal combustion engine or electric motor for rotating a water pump. A flexible hose member 78 extends between the source of high pressure water and the water inlet valve. A hand actuated trigger assembly 80 may be attached to the water inlet valve, hand grip or universal handle to operate a water inlet valve assembly. The valve actuating trigger may be squeezed with a person's hand to allow the water to be turned on and off to the device. The water inlet valve may be threadably coupled directly to the water inlet 28 or alternatively, a second flexible member 82 may be utilized in conjunction with the extendable handle.

Referring to FIGS. 1-10, in operation high pressure water is received from the high pressure water source through the flexible hose member 78. Depression of the valve assembly trigger 80 allows the water to flow into inlet conduit 28 and the nozzle 82 to strike the impeller 40, wherein the high pressure water impacts the impeller vanes 46 at an angle substantially perpendicular to the axis of rotation A causing rotation of the impeller and the drive shaft 50 which in turn rotates the backing pad 54. The water that is impacted against the impeller vanes is centrifugally evacuated through the exhaust channel 26 which directs the water outwardly through the exhaust aperture 30 and away from the backing pad.

In the preferred embodiment, the components comprising the housing are formed of, but not limited to, a suitable metal material through the process of machining or precision casting. In a most preferred embodiment the housing is formed of hard anodized aluminum for minimum weight and corrosion resistance. In the preferred embodiment, the components comprising the impeller and drive shaft are formed of, but not limited to, a suitable metal material through the process of machining or precision casting. In a most preferred embodiment the impeller and the drive shaft are formed of stainless steel. The result is that the components comprising the water powered rotary tool 10 are lightweight and corrosion resistant leaving the external surface in a generally smooth condition for aesthetic purposes, as shown in FIG. 1.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A water powered rotary tool comprising:

a housing, said housing including an upper portion and a lower portion, said lower portion including a removable and replaceable first bearing, said first bearing axially aligned within a centrally located impeller cavity, said impeller cavity including an upper portion and a lower portion, said lower portion of said impeller cavity having a substantially cylindrical shape, a water inlet for allowing high pressure water into said impeller cavity, said upper portion of said impeller cavity including an exhaust channel, said exhaust channel having a substantially oval shape, said exhaust channel constructed and arranged to utilize centrifugal force to direct said high pressure water to a water exhaust for exhausting said high pressure water from said impeller cavity, said housing including at least one integrally formed boss on an external surface thereof, said at least one boss including a threaded aperture for removable attachment of a handgrip;

an impeller, said impeller including an upper side plate and a lower side plate, a plurality of vanes extending between said side plates, a centrally located aperture for a drive shaft, said drive shaft defining an axis of rotation for said impeller, said drive shaft constructed and arranged to extend through said impeller aperture and engage said impeller as well as said first bearing, said drive shaft having sufficient length to extend through an aperture centrally located in said lower portion of said housing for attachment to a backing disk;

a backing disk for attachment of an abrasive medium to said drive shaft, wherein rotation of said impeller causes rotation of said backing disk;

a handgrip for operator manipulation of said water powered rotary tool, said handgrip removably secured to said at least one integrally formed boss;

a source of high pressure water connected to said water inlet via a flexible hose member, wherein said high pressure water impacts said impeller vanes at an angle substantially perpendicular to said axis of rotation causing rotation of said impeller.

2. The water powered rotary tool in accordance with claim 1 wherein said impeller vanes have a chevron shape.

3. The water powered rotary tool in accordance with claim 2 wherein said impeller vanes include cusped edges.

4. The water powered rotary tool in accordance with claim 3 wherein said impeller includes about 19 vanes.

5. The water powered rotary tool in accordance with claim 1 including an extendable handle, wherein said handle is secured to said at least one integrally formed bosses.

6. The water powered rotary tool in accordance with claim 5 wherein said extendable handle includes a universal joint for pivotal movement of said extendable handle with respect to said housing.

7. The water powered rotary tool in accordance with claim 1 including a valve for controlling the flow of said high pressure water into said water inlet, said valve including a hand operated trigger, said trigger constructed and arranged to open and close said valve.

8. The water powered rotary tool in accordance with claim 1 wherein said water inlet includes a removable and replaceable nozzle, said nozzle including an orifice for controlling a jet of high pressure water.

9. The water powered rotary tool in accordance with claim 8, wherein said nozzle orifice may be varied in diameter to control revolutions per minute and torque developed by said impeller.

10. The water powered rotary tool in accordance with claim 8 wherein said metal is aluminum.

11. The water powered rotary tool in accordance with claim 10 wherein said aluminum includes a hard anodized surface for wear reduction and corrosion resistance.

12. The water powered rotary tool in accordance with claim 1 wherein said housing is constructed from metal.

13. The water powered rotary tool in accordance with claim 1 wherein said impeller and said drive shaft are constructed from metal.

14. The water powered rotary tool in accordance with claim 13 wherein said metal is stainless steel.

* * * * *